US006644044B2

(12) United States Patent
Kranz et al.

(10) Patent No.: US 6,644,044 B2
(45) Date of Patent: Nov. 11, 2003

(54) REFRIGERATOR, MARKING SYSTEM, AND METHOD FOR MARKING

(75) Inventors: Thomas Kranz, Giengen (DE); Walter V. D. Woldenberg, Syrgenstein (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/348,439

(22) Filed: Jan. 21, 2003

(65) Prior Publication Data

US 2003/0110783 A1 Jun. 19, 2003

Related U.S. Application Data

(63) Continuation of application No. PCT/EP01/08247, filed on Jul. 17, 2001.

(30) Foreign Application Priority Data

Jul. 20, 2000 (DE) ..... 200 12 619 U

(51) Int. Cl.[7] ..... F25B 1/00
(52) U.S. Cl. ..... 62/115; 62/125; 285/93
(58) Field of Search ..... 62/125, 115, 298; 285/93; 116/200, 201, 209; 40/299.01

(56) References Cited

U.S. PATENT DOCUMENTS

| | | | | |
|---|---|---|---|---|
| 3,273,585 A | * | 9/1966 | Patch | 137/240 |
| 5,383,338 A | * | 1/1995 | Bowsky et al. | 62/125 |
| 5,468,022 A | | 11/1995 | Linder et al. | |

FOREIGN PATENT DOCUMENTS

| | | |
|---|---|---|
| CH | 502 546 | 7/1971 |
| EP | 0 568 510 A1 | 11/1993 |
| EP | 0 789 206 A2 | 8/1997 |

* cited by examiner

*Primary Examiner*—William E. Tapolcai
(74) *Attorney, Agent, or Firm*—Laurence A. Greenberg; Werner H. Stemer; Gregory L. Mayback

(57) ABSTRACT

A multi-temperature refrigerator, of which the evaporators serving for cooling the compartments of different temperature can be activated separately through a 3/2-way solenoid valve, the solenoid valve being followed, for lowering the pressure of the refrigerant in relation to the respective evaporator, by a throttle line includes a marking on the throttle for mounting the line in a correct position on the solenoid valve. The invention forms the marking for the throttle lines with a separate component that can be applied to the throttle line positively and/or nonpositively.

21 Claims, 1 Drawing Sheet

REFRIGERATOR, MARKING SYSTEM, AND METHOD FOR MARKING

CROSS-REFERENCE TO RELATED APPLICATION

This application is a continuation of copending International Application No. PCT/EP01/08247, filed Jul. 17, 2001, which designated the United States and was not published in English.

BACKGROUND OF THE INVENTION

Field of the Invention

The invention relates to a refrigerator with a heat-insulating housing, within which are provided at least two refrigerating compartments of different temperature, the evaporators of which can be activated separately from one another by at least one activation element, each of the evaporators being preceded on the inflow side by a throttle line serving for lowering the pressure of the refrigerant forcibly circulated by a refrigerant compressor, at least one of the throttle lines being equipped with a marking for placing it in the correct position to the activation element.

In refrigerators with multiple temperature zones, it is conventional, for acting upon the evaporators associated with the individual refrigerating compartments, to use 3/2-way solenoid valves that are followed by what are referred to as capillary tubes for lowering the pressure of the refrigerant forcibly circulated by a refrigerant compressor. To connect the capillary tubes in the correct position to the outlets of the 3/2-way solenoid valve, hitherto, markings on the capillary tubes have been used in the form of color markings and a wavy shape of the capillary tube. In such an identification of the capillary tubes, it was shown that, after the refrigerator has run through the preceding production sequence, in most cases the identification for connecting the capillary tube in the correct position to the solenoid valve is unrecognizable to the extent that an unequivocal association of the respective capillary tube to the correct outlet of the solenoid valve is no longer possible for a production worker.

SUMMARY OF THE INVENTION

It is accordingly an object of the invention to provide a refrigerator, a marking system, and a method for marking that overcome the hereinafore-mentioned disadvantages of the heretofore-known devices and methods of this general type and that rectifies the disadvantages of the prior art by simple structural measures.

With the foregoing and other objects in view, there is provided, in accordance with the invention, a refrigerator, including a heat-insulating housing defining at least two refrigerating compartments of different temperatures, evaporators associated with each of the compartments, each of the evaporators having an inflow side, at least one activation element connected to the evaporators and separately activating each of the evaporators, throttle lines respectively connected to each of the evaporators at the inflow side for circulating refrigerant, a refrigerant compressor connected to the throttle lines and to the at least one activation element, and forcibly circulating the refrigerant in the throttle lines, at least one of the refrigerant compressor and the throttle lines lowering pressure of the refrigerant circulated by the refrigerant compressor, and at least one of the throttle lines having a marking for assigning the at least one throttle line in a correct position with respect to the at least one activation element, the marking being formed by a separate structural element applied one of positively and nonpositively to the at least one throttle line.

According to the invention, the marking is formed by a separate structural element applied positively and/or nonpositively to the throttle line.

By the identification, according to the invention, of the connection-side throttle pipeline section facing the activation element configured, for example, as a 3/2-way solenoid valve, a marking for the throttle pipeline is provided, which, even after a runthrough production, ensures a permanent, clearly visible, and, therefore, direct association of the throttle line end sections to the respective outlet of the solenoid valve. A production worker can, consequently, mount onto the line ends in the correct position quickly and specifically in a simple way. Furthermore, such an identification of the throttle line is insensitive both in the case of thermal influences arising during the run of the refrigerator through production and to deformations on the throttle lines configured as a capillary tube. To that extent, a permanent identification of the throttle line is provided, which makes it possible to handle a refrigerator in the production process of the latter without special precautionary measures taking the identification into account.

A structural element serving for identifying the throttle lines can be provided particularly cost-effectively when, in accordance with another feature of the invention, the structural element is configured as a commercially available standard component. Consequently, by a commercially available standard component being used, the cost-intensive specific development of a component for marking the throttle line is avoided.

The structural element can be attached particularly simply to the throttle line configured as a capillary tube when, in accordance with a further feature of the invention, the structural element is provided, at least in portions, on the outer surface of the throttle line on the circumference of the throttle line.

The throttle line end sections to be connected on the outlet side to the multi-way solenoid valve can be distinguished particularly clearly in visible terms when, in accordance with an added feature of the invention, the structural element surrounds the throttle line in a tube-like manner in the fastening state. By the connection section of the throttle lines being clearly identified visibly, not only is the connection work made markedly easier for the production personnel, but also, moreover, the time spent in correct position placement is also appreciably reduced.

The commercially available structural element serving for identifying the throttle lines, on one hand, can be provided cost-effectively and, on the other hand, can be attached particularly quickly, reliably in position, and easily in terms of production when, in accordance with an additional feature of the invention, the structural element is configured as a commercially available standard crimped part.

In accordance with yet another feature of the invention, the at least one structural element is a plurality of structural elements connected to at least some of the throttle lines and respectively identifying each of the throttle lines.

In accordance with yet a further feature of the invention, the structural element is a plurality of structural elements connected to at least some of the throttle lines, a number of the structural elements on a respective one of the throttle lines providing a unique identification of the at least some of the throttle lines.

In accordance with yet an added feature of the invention, the at least one structural element ifs a plurality of structural elements and a different number of the structural elements is connected to each of the throttle lines for respectively identifying each of the throttle lines from one another.

In the case of a plurality of throttles configured as capillary tubes, reliably position placement to the connections of the multi-way solenoid valve is ensured in a particularly simple way when, each of the throttle lines is identified, the number of structural elements that serve for identification being different for each throttle line.

With the objects of the invention in view, in combination with a refrigerator having a heat-insulating housing defining at least two refrigerating compartments of different temperatures, evaporators associated with each of the compartments, each of the evaporators having an inflow side, at least one activation element connected to the evaporators and separately activating each of the evaporators, throttle lines respectively connected to each of the evaporators at the inflow side for circulating refrigerant, and a refrigerant compressor connected to the throttle lines and to the at least one activation element, and forcibly circulating the refrigerant in the throttle lines, at least one of the refrigerant compressor and the throttle lines lowering pressure of the refrigerant circulated by the refrigerant compressor, there is also provided a marking system including a marking connected to at least one of the throttle lines for assigning the at least one throttle line in a correct position with respect to the at least one activation element, the marking being formed by a separate structural element applied one of positively and nonpositively to the at least one throttle line.

With the objects of the invention in view, there is also provided a marking system for assigning at least one throttle line in a correct position with respect to at least one activation element of a refrigerator, including a marking to be connected to the at least one throttle line, the marking being formed by a separate structural element applied one of positively and nonpositively to the at least one throttle line.

With the objects of the invention in view, there is also provided a method for identifying throttle lines in a refrigerator having different refrigeration compartments, including the steps of fluidically connecting throttle lines to evaporators associated with each of the refrigeration compartments and identifying each of the throttle lines by one of positively and nonpositively applying structural elements to at least one of the throttle lines, a number of the structural elements on a respective one of the throttle lines providing a unique identifier for the respective one of the throttle lines associated therewith.

Other features that are considered as characteristic for the invention are set forth in the appended claims.

Although the invention is illustrated and described herein as embodied in a refrigerator, a marking system, and a method for marking, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
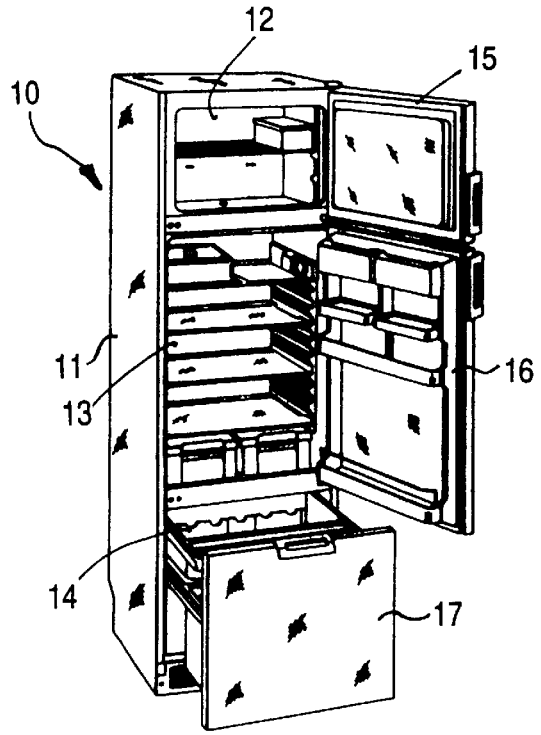
FIG. 1 is a perspective front view of a three-temperature household refrigerator with compartments of different temperature separated thermally from one another, cooled by a refrigerating power adapted by an evaporator.

Referring now to the figures of the drawings in detail and first, particularly to FIG. 1 thereof, there is shown a three-temperature household refrigerator 10 with a heat-insulating housing 11. The housing 11 serves for the reception of three refrigerating compartments 12, 13, 14 that are separated from one another in a heat-insulating manner and each of which can be closed by a separate door 15, 16, 17. Of the refrigerating compartments 12, 13, 14, the upper compartment capable of being closed by the door 15 is configured as a freezing compartment and the middle compartment 13, to which the door 16 is assigned, is configured as a normal refrigerating compartment, while the lower refrigerating compartment 14 serves as a cellar compartment and can be closed by the door 17. The different temperatures in the individual refrigerating compartments 12, 13, 14 are maintained by a refrigerating system 18 illustrated in simplified form in FIG. 2.

Figure 2:
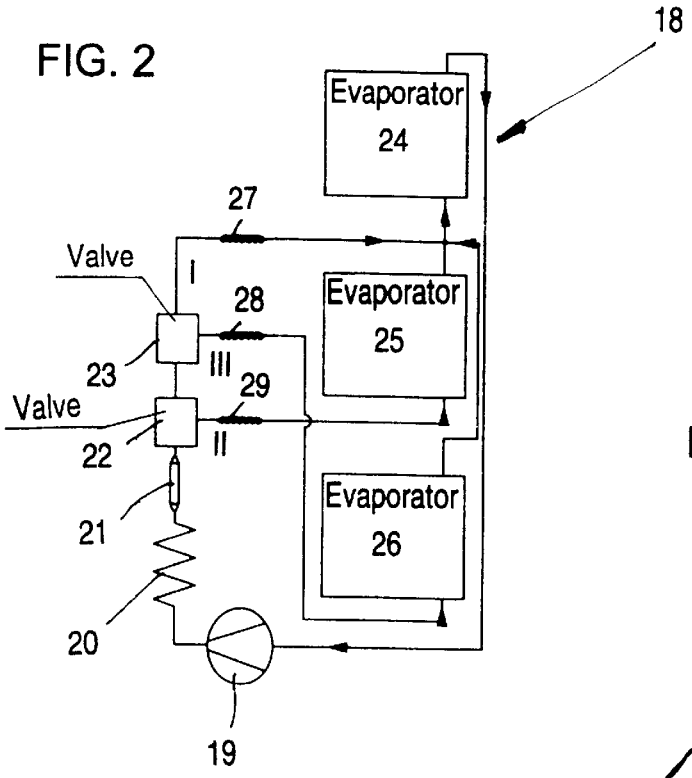
FIG. 2 is a block and schematic circuit diagram of a refrigerating system of the refrigerator of FIG. 1 having the evaporators disposed therein and being equipped on the inflow side with a throttle device.

In the refrigerating system 18 illustrated in FIG. 2, for the sake of simplicity, the electronic regulating device and its signal and activation lines have been omitted. The refrigerating system 18 possesses a compressor 19 that is followed on the pressure side, in a series connection, by a condenser 20 and a dryer 21. The dryer 21 is connected on the outflow side to a first electrically operated 3/2-way solenoid valve 22 that is flow-coupled with one of its outlets to the inlet of a second identical 3/2-way solenoid valve 23, so as to form a series connection between these two. The still free outlets of the valve units disposed in a series connection to one another and configured as electromagnetically operated 3/2-way valves form three different refrigerating circuits I, II, and III that can be acted upon by a refrigerant. The 3/2-way solenoid valves 22 and 23 are an integral part of the refrigerant circuits I, II, and III and serve as activation elements for the supply of refrigerant to the respective refrigerating circuit, the solenoid valves 22, 23 diverting the refrigerant flow arriving from the condenser 20 through the dryer cartridge 21 into one of the circuits I, II, III. Each of the outlets of the 3/2-way solenoid valves, which constitute the inlet to the refrigerating circuits I, II, III, is followed directly by an evaporator, a first evaporator 24 that lies in the refrigerating circuit I serving for cooling the freezing compartment 12, a second evaporator 25 that lies in the refrigerating circuit III serving for maintaining the temperature in the normal refrigerating compartment 13, and a last evaporator 26 that lies in the refrigerating circuit II serving for cooling the cellar compartment 14. A throttle element 27, 28, and 29 is provided in each case between the inlets of the evaporators 24, 251 26 and the outlets of the 3/2-way solenoid valves 22 and 23, the outlets serving as inlets for the refrigerating circuits I to III. Each of these throttle elements 27, 28, 29 is configured, in the present case, as a capillary tube that is wound in a spiral-like manner and that serves for lowering the pressure of the refrigerant coming from the condenser 20 to the respective working pressure of the respectively assigned evaporator 24, 25, 26.

Figure 3:
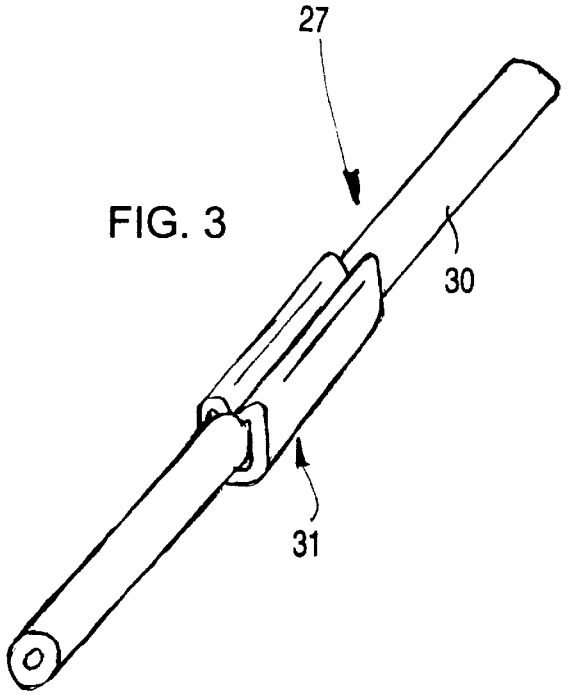
FIG. 3 is a fragmentary, perspective view of a detail of an exemplary embodiment of a throttle device according to the invention configured as a capillary tube with a marking applied on the outer surface thereof.

As is evident particularly from FIG. 3, the throttle elements 27, 28, 29 configured as capillary tubes (the capillary tube 27 is illustrated here by way of example) are provided on their outer surface 30 with a commercially available structural element 31 serving as a marking. The structural elements 31 provided for identifying the individual capillary tubes serve for indicating the correctly positioned assignment to the outlets of the solenoid valves 22 and 23 for the activation of the individual evaporators 24, 25, 26. To identify the assignment of the capillary tubes to the outlets of the solenoid valves 22 and 23, for example, the capillary tube 27 introduced into the refrigerating circuit I is provided with one structural element 31, the capillary tube 28 introduced into the refrigerating circuit II is provided with two structural elements 31 and the capillary tube 29 introduced into the refrigerating circuit III is provided with three structural elements 31. The structural elements 31 are configured, in the present case, as standard crimped parts and surround the outer surface 30 of the capillary tubes 27, 28, 29 in a tube-like manner over a defined length. The structural elements 31 disposed on the outer surface of the throttle lines 27, 28, 29 configured as a capillary tube are secured to the outer surface 30 positively and nonpositively, the fastening of the structural elements 31 configured as commercially available crimped parts being achieved by the deformation of these in the manner of a tube. By virtue of the tube shape of the structural elements 31, their inside surrounds the outer surface 30 of the throttle lines 27, 28, 29, and, in particular, those free ends of the structural elements 31 that face one another after the tube-like shaping dig at least slightly into the outer wall of the throttle lines 27, 28, 29 for the fastening of these structural elements. The structural elements 31 are, thereby, held in a non-slip manner on the outer wall of the throttle lines 27, 28, 29.

By virtue of the type of identification of the throttle lines 27, 28, 29 by the structural elements 31, on one hand, and their positive and nonpositive fastening, on the other hand, a marking on the throttle lines 27, 28, 29 is provided, which, even during the run of a refrigerator through production, is secured on the throttle lines 27 28, 29 reliably in position and in a clearly visible way. Such a configuration makes it appreciably easier for the production personnel to assign the individual throttle lines 27, 281 29 to the corresponding outlets of the solenoid valves 22 and 23.

It goes without saying that, in addition to the exemplary number described of the structural elements 31 provided for identifying the throttle lines 27, 28, 29, other numerical assignments of the structural elements 31 to distinguish between the throttle lines 27, 28, 29 and to assign them to the outlets of the solenoid valves 22 and 23 are also possible.

We claim:

1. A refrigerator, comprising:

a heat-insulating housing defining at least two refrigerating compartments of different temperatures;

evaporators associated with each of said compartments, each of said evaporators having an inflow side;

at least one activation element connected to said evaporators and separately activating each of said evaporators;

throttle lines respectively connected to each of said evaporators at said inflow side for circulating refrigerant;

a refrigerant compressor connected to said throttle lines and to said at least one activation element, and forcibly circulating the refrigerant in said throttle lines, at least one of said refrigerant compressor and said throttle lines lowering pressure of the refrigerant circulated by said refrigerant compressor; and at least one of said throttle lines having a marking for assigning said at least one throttle line in a correct position with respect to said at least one activation element, said marking being formed by a separate structural element applied one of positively and nonpositively to said at least one throttle line.

2. The refrigerator according to claim 1, wherein said structural element is a-commercially available standard component.

3. The refrigerator according to claim 1, wherein:

said at least one throttle line has an outer surface; and said structural element is disposed on at least a portion of said outer surface.

4. The refrigerator according to claim 2, wherein:

said at least one throttle line has an outer surface; and said structural element is disposed on at least a portion of said outer surface.

5. The refrigerator according to claim 1, wherein:

said at least one throttle line has an outer surface; and said structural element is disposed, at least in portions, on said outer surface.

6. The refrigerator according to claim 1, wherein, in a fastened state, said structural element surrounds said at least one throttle line in the manner of a tube.

7. The refrigerator according to claim 1, wherein, in a fastened state, said structural element surrounds said at least one throttle line as a tube.

8. The refrigerator according to claim 1, wherein said structural element is a commercially available standard crimped part.

9. The refrigerator according to claim 1, wherein said at least one structural element is a plurality of structural elements connected to at least some of said throttle lines and respectively identifying each of said throttle lines.

10. The refrigerator according to claim 1, wherein said at least one structural element is a plurality of structural elements connected to at least some of said throttle lines, a number of said structural elements on a respective one of said throttle lines providing a unique identification of said at least some of said throttle lines.

11. The refrigerator according to claim 1, wherein:

said at least one structural element is a plurality of structural elements; and a different number of said structural elements is connected to each of said throttle lines for respectively identifying each of said throttle lines from one another.

12. In combination with a refrigerator having a heat-insulating housing defining at least two refrigerating compartments of different temperatures, evaporators associated with each of the compartments, each of the evaporators having an inflow side, at least one activation element connected to the evaporators and separately activating each of the evaporators, throttle lines respectively connected to each of the evaporators at the inflow side for circulating refrigerant, and a refrigerant compressor connected to the throttle lines and to the at least one activation element, and forcibly circulating the refrigerant in the throttle lines, at least one of the refrigerant compressor and the throttle lines lowering pressure of the refrigerant circulated by the refrigerant compressor, a marking system comprising:

a marking connected to at least one of the throttle lines for assigning the at least one throttle line in a correct position with respect to the at least one activation element, said marking being formed by a separate structural element applied one of positively and nonpositively to the at least one throttle line.

13. The refrigerator according to claim 12, wherein said structural element is a commercially available standard component.

14. The refrigerator according to claim 12, wherein:

said at least one throttle line has an outer surface; and said structural element is disposed on at least a portion of said outer surface.

15. The refrigerator according to claim 12, wherein, in a fastened state, said structural element surrounds said at least one throttle line in the manner of a tube.

16. The refrigerator according to claim 12, wherein said structural element is a commercially available standard crimped part.

17. The refrigerator according to claim 12, wherein said at least one structural element is a plurality of structural elements connected to at least some of said throttle lines and respectively identifying each of said throttle lines.

18. The refrigerator according to claim 12, wherein said at least one structural element is a plurality of structural elements connected to at least some of said throttle lines, a number of said structural elements on a respective one of said throttle lines providing a unique identification of said at least some of said throttle lines.

19. The refrigerator according to claim 12, wherein:

said at least one structural element is a plurality of structural elements; and a different number of said structural elements is connected to each of said throttle lines for respectively identifying each of said throttle lines from one another.

20. A marking system for assigning at least one throttle line in a correct position with respect to at least one activation element of a refrigerator, comprising:

a marking to be connected to the at least one throttle line, said marking being formed by a separate structural element applied one of positively and nonpositively to the at least one throttle line.

21. A method for identifying throttle lines in a refrigerator having different refrigeration compartments, which comprises:

fluidically connecting throttle lines to evaporators associated with each of the refrigeration compartments; and identifying each of the throttle lines by one of positively and nonpositively applying structural elements to at least one of the throttle lines, a number of the structural elements on a respective one of the throttle lines providing a unique identifier for the respective one of the throttle lines associated therewith.

* * * * *